US005711831A

United States Patent [19]

Taylor

[11] Patent Number: 5,711,831

[45] Date of Patent: Jan. 27, 1998

[54] SYSTEM AND METHOD FOR CONTROLLING LABEL CURL

[75] Inventor: J. E. Gordon Taylor, Centerville, Ohio

[73] Assignee: NCR Corporation, Dayton, Ohio

[21] Appl. No.: 708,378

[22] Filed: Sep. 4, 1996

[51] Int. Cl.[6] ..... B65C 5/04

[52] U.S. Cl. ..... 156/64; 156/264; 156/269; 156/302; 156/322; 156/DIG. 43

[58] Field of Search ..... 156/DIG. 21, DIG. 43, 156/64, 264, 269, 289, 302, 324, 322

[56] References Cited

U.S. PATENT DOCUMENTS

| | | | |
|---|---|---|---|
| 3,802,984 | 4/1974 | Brugh, Jr. et al. . | |
| 4,035,218 | 7/1977 | Yount | 156/324 |
| 4,055,454 | 10/1977 | Laske . | |
| 4,069,081 | 1/1978 | Drower et al. . | |
| 4,302,269 | 11/1981 | Steinberg et al. . | |
| 4,437,918 | 3/1984 | Morohashi et al. . | |
| 4,738,891 | 4/1988 | Vighi . | |
| 5,288,357 | 2/1994 | Yamada et al. . | |
| 5,405,475 | 4/1995 | Kraft et al. . | |

*Primary Examiner*—Michael W. Ball
*Assistant Examiner*—Michael A. Tolin
*Attorney, Agent, or Firm*—Charlene Stukenborg

[57] ABSTRACT

A system and method for producing a form and label combination product with a reduced tendency to curl is provided. Paper stock forms the form and label face while liner stock covers the hot melt pressure sensitive adhesive. A dryer dries the paper stock so the combined paper stock and liner expand substantially the same amount when reaching moisture equilibrium with the environment and have a reduced tendency to curl.

6 Claims, 1 Drawing Sheet

SYSTEM AND METHOD FOR CONTROLLING LABEL CURL

BACKGROUND OF THE INVENTION

The present invention relates to a system and method for controlling label curl, particularly in form and label combination products.

When manufacturing forms including pressure sensitive labels, a machine applies cut sections of a paper web of liner, coated in-line with hot melt pressure sensitive adhesive, to a limited area of a continuous web of the paper stock. Then the label portion is die-cut for the appropriate label configuration and the paper stock is cut into separate single sheets of business form and label combinations. These single sheets are then later imaged using sheet fed devices (e.g. laser sheet printers). These images may include printed text on the form and/or label portions.

Using traditional methods of manufacturing, the single sheets have a tendency to curl around the cross-web axis of the form in the label area and thus jam in the single sheet imaging equipment. The tendency to curl occurs as moisture is driven from the liner (causing the liner to shrink) when the hot melt pressure sensitive adhesive is applied and the moisture returns as the liner cools and reaches moisture equilibrium with the environment (causing the liner to expand) after being joined with the paper stock. One method to eliminate this problem is to add water to the liner after the hot melt pressure sensitive adhesive is applied. However, this process requires controlled machinery to rewet the liner sheet to the appropriate moisture content. A simpler yet effective method of producing single sheet business form and label combinations with a reduced tendency to curl is desired.

SUMMARY OF THE INVENTION

In accordance with the teachings of the present invention, a system and method for producing single sheet business form and label combinations with a reduced tendency to curl is provided.

It is an object of the present invention to provide a system and method for producing business form and label combinations which have a reduced tendency to curl even when using papers which are poorly controlled in moisture content when entering the process.

It is another object of the present invention to provide a system and method which uses the actual curl tendency of freshly made forms to guide feedback to correct the process almost immediately.

BRIEF DESCRIPTION OF THE DRAWINGS

Additional benefits and advantages of the present invention will become apparent to those skilled in the art to which this invention relates from the subsequent description of the preferred embodiments and the appended claims, taken in conjunction with the accompanying drawings, in which:

DETAILED DESCRIPTION

Figures 1, 2:
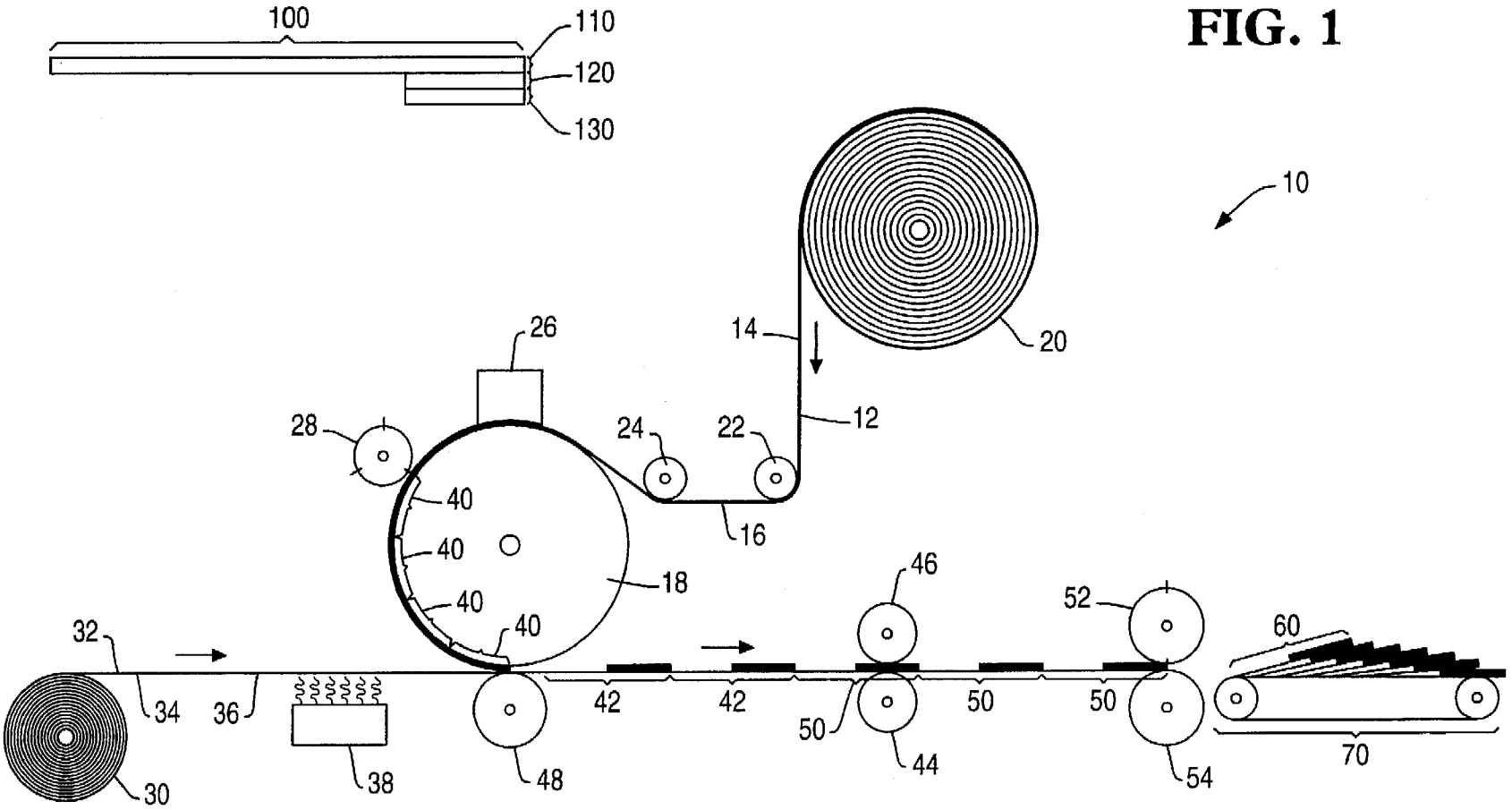
FIG. 1 shows a system for producing combination business forms and labels having a reduced tendency to curl according to the present invention.
FIG. 2 shows a product having a reduced tendency to curl made by the system and method of the present invention.

Referring now to the drawings, in which like-referenced characters indicate corresponding elements throughout the several views, attention is first drawn to FIG. 1 which shows a system 10 for producing combination forms and labels of the present invention. System 10 includes a liner unwind roll 20. Liner 16 on liner unwind roll 20 has a front surface 14 and a back surface 12. At least front surface 14 is coated with a release coating such as silicone or other known release coatings. Optionally, back surface 12 may also be coated with a release coating. Continuous web or liner 16 passes by liner guide rollers 22 and 24 to pressure sensitive adhesive applicator 26. Pressure sensitive adhesive applicator 26 includes adhesive such as hot melt adhesive which is applied at a temperature of about 300° F. When the adhesive is applied to liner front surface 14, the temperature of the liner increases and moisture is driven out. Thus the overall moisture content of liner 16 is decreased from ambient and liner 16 shrinks. Next liner 16 with the pressure sensitive adhesive is advanced to the liner adhesive cutoff roller 28 which cuts the combination into segments 40. Rotating vacuum cylinder 18 holds the segments 40 until placement on paper stock 36 is desired.

System 10 also includes a paper stock unwind roller 30. Paper stock 36 on paper stock unwind roller 30 has a back surface 32 and a front surface 34. Paper stock 36 may be of a heavier stock than liner stock. Paper stock moves along until being contacted by segments 40 of liner 16 and pressure sensitive adhesive where the label portion of the form is to be created. According to the present invention, before paper stock 36 is merged with segments 40, paper stock 36 is exposed to dryer 38 which dries paper stock 36 so that the moisture content of paper stock 36 is similar or substantially the same as liner 16 with the hot melt pressure sensitive adhesive applied. Dryer 38 may include, but is not limited to, impingement of heated air, contact with heated rollers or heated platens, irradiation by infrared lamps (preferably having an adjustable shutter), or by microwave devices. Dryer 38 includes dryer controls to adjust either the temperature or the distance of dryer 38 so the drying effect on paper stock 36 may be adjusted. Any device which drives moisture from paper stock 36 without permanently changing paper stock 36 may be used. After paper stock 36 is dried, vacuum roller guide roller 48 guides paper stock 36 so it is merged with liner and pressure sensitive adhesive segments 40.

Paper stock is merged with a segment of liner and pressure sensitive adhesive at predetermined spaces to provide form and liner combinations 42 which are still in a continuous web. Die cut roller 44 and die cut guide roller 46 cooperate to provide die cuts in the front surface 34 of paper stock in the continuous web of form and liner combinations 42. Form and label combinations 50 proceed toward form cut roller 52 and associated form cut guide roller 54. Form cut roller 52 cuts form and label combinations 50 into finished product 60. Conveyor 70 moves finished product 60 away from the system of the present invention. Guide rollers and cutters can be any standard design.

When both the paper stock and the liner return to moisture equilibrium with the environment, both the paper stock and the liner expand. If the paper stock and the liner expand substantially the same amount, there is a reduced tendency to curl in the final product 60. Although liner and hot melt pressure sensitive adhesive may heat and thus dry paper stock somewhat when the plies are merged, the percentage of loss of moisture may be different resulting in a tendency to curl. If finished product 60 does exhibit some tendency to curl, the temperature or location of dryer 38 may be adjusted to provide the needed drying of paper stock 36 so the tendency to curl is eliminated. If the form tends to curl toward the paper stock, this generally indicates that the paper stock needs to be dried more. If the form and label combination tends to curl away from the paper stock, this indicates that the paper stock should be dried less. By adjusting the dryer, form and label combinations with a reduced tendency to curl can be easily and economically obtained. The tendency to curl can be determined by an inspector or a standard manufacturing sensor a few minutes after the merging of the plies. This determination of tendency to curl can provide feedback to dryer 38 and dryer controls can be adjusted accordingly.

Referring to FIG. 2, a form and label combination 100 of the present invention is shown. Form and label combination 100 includes paper stock 110 having a layer of pressure sensitive adhesive 120 on one side near one edge. A release coated liner 130 is positioned on and covers pressure sensitive adhesive 120. Because paper stock 110 was dried by dryer 38 before being merged with the pressure sensitive adhesive and liner combination, the final form and label combination 100 has a reduced tendency to curl.

An advantage of this system and method is the ability to accommodate changing quality of the liner stock and the paper stock in terms of moisture content by monitoring any tendency to curl in recently produced product and adjusting the dryer accordingly.

Another advantage of this system and method is the ability to produce form and label combination products which have a reduced tendency to curl and thus are less likely to jam in machines when being printed upon or otherwise processed.

Although the present invention has been described in relation to a form and label combination product, the system and method may also be used with labels only which are to be fed through single sheet devices such as laser printers.

Although the invention has been described with particular reference to certain preferred embodiments thereof, variations and modifications of the present invention can be effected within the spirit scope of the following claims.

What is claimed is:

1. A method of producing a form and label combination product having a reduced tendency to curl, comprising the steps of:

providing a liner having a front surface;

applying a hot melt pressure sensitive adhesive to the front surface of the liner;

providing a paper stock having a back surface;

drying the paper stock; then attaching the liner and hot melt pressure sensitive adhesive to a predetermined portion of the paper stock on the back surface of the paper stock, wherein the predetermined portion of the paper stock forms a label portion; and die-cutting the label portion to form at least one label.

2. The method of claim 1 wherein the paper stock is dried so the liner and the paper stock will expand substantially the same amount when reaching moisture equilibrium with the environment.

3. The method of claim 1 wherein the step of drying the paper stock is performed using heated air.

4. The method of claim 1 wherein the step of drying the paper stock is performed by contact with heated rollers.

5. The method of claim 1 wherein the step of drying the paper stock is performed by irradiation.

6. The method of claim 1 further comprising the step of:

adjusting the drying of the paper stock if a tendency to curl is determined in newly produced product.

* * * * *